United States Patent [19]

Correll

[11] Patent Number: 4,507,586

[45] Date of Patent: Mar. 26, 1985

[54] TRAVELING WAVE PUSH-PULL ELECTRON BEAM DEFLECTOR WITH PITCH COMPENSATION

[75] Inventor: Ronald E. Correll, Tualatin, Oreg.

[73] Assignee: Tektronix, Inc., Beaverton, Oreg.

[21] Appl. No.: 437,089

[22] Filed: Oct. 27, 1982

[51] Int. Cl.[3] ..... H01J 23/16; H01J 29/96

[52] U.S. Cl. ..... 315/3; 315/3.6; 313/421

[58] Field of Search ..... 315/3, 3.6; 313/421, 313/422

[56] References Cited

U.S. PATENT DOCUMENTS

| | | | |
|---|---|---|---|
| 3,005,128 | 10/1961 | Goldberg et al. | 315/3.6 X |
| 3,174,070 | 3/1965 | Moulton | 315/3 |
| 3,504,222 | 3/1970 | Fukushima | 315/3 |
| 3,694,689 | 9/1972 | Odenthal et al. | 315/3 |
| 3,849,695 | 11/1974 | Piazza et al. | 315/3 |
| 4,093,891 | 6/1978 | Christie et al. | 315/3 |
| 4,207,492 | 6/1980 | Tomison et al. | 315/3 |

FOREIGN PATENT DOCUMENTS

| | | | |
|---|---|---|---|
| 4416697 | 3/1966 | Japan | 313/421 |

*Primary Examiner*—Saxfield Chatmon

*Attorney, Agent, or Firm*—John D. Winkelman; Paul S. Angello

[57] ABSTRACT

An electron beam deflection structure (10) of the traveling wave type includes first and second deflection members (52 and 58) positioned on opposite sides of and extending along the path of an electron beam (26) to deflect the beam in response to deflection signals applied to the deflection members. In a preferred embodiment, both deflection members are of a meander line type which include a plurality of deflection plate segments (74, 76) connected in series by a plurality of lead portions (78) to form a pair of transmission lines, each transmission line having a characteristic impedance that tends to vary with distance along the path of the electron beam due to a flared spacing between the output portions of the deflection members. Pitch compensation including different pitches for the first and second deflection members increases and maintains substantially uniform the characteristic impedance of each transmission line to prevent reflection of the deflection signal back toward the input end of the line.

12 Claims, 7 Drawing Figures

FIG. 1
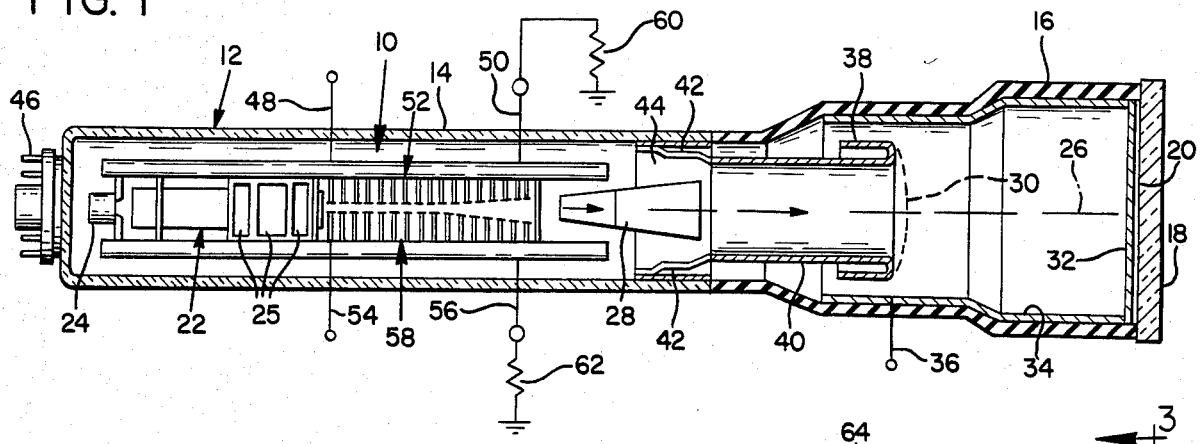
FIG. 2
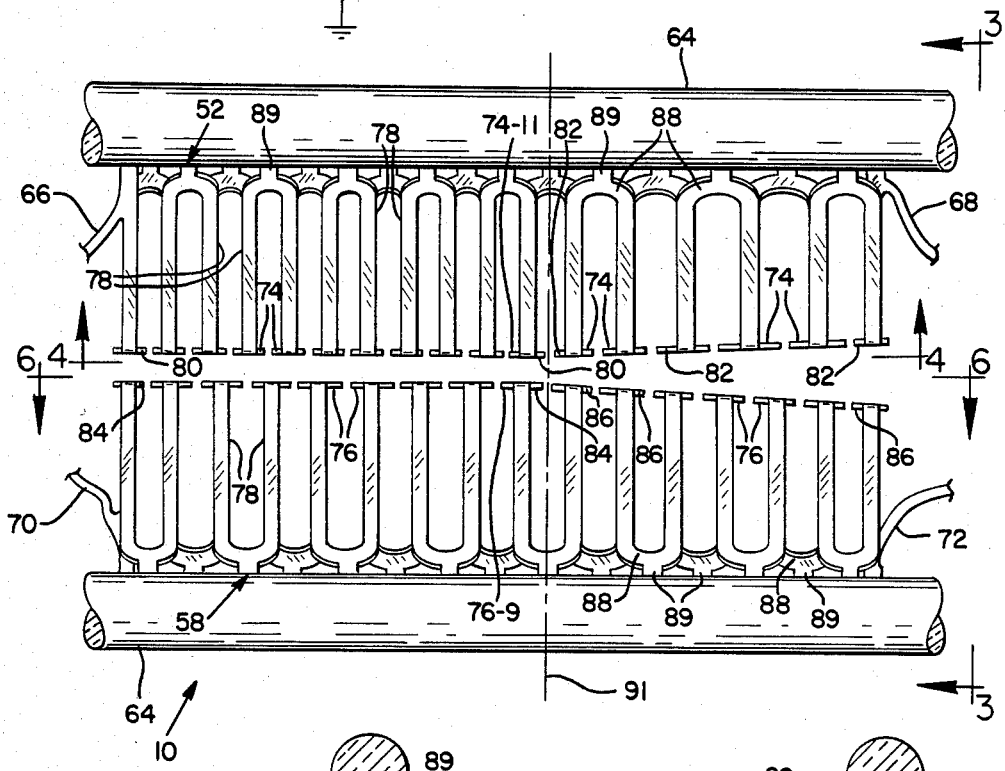
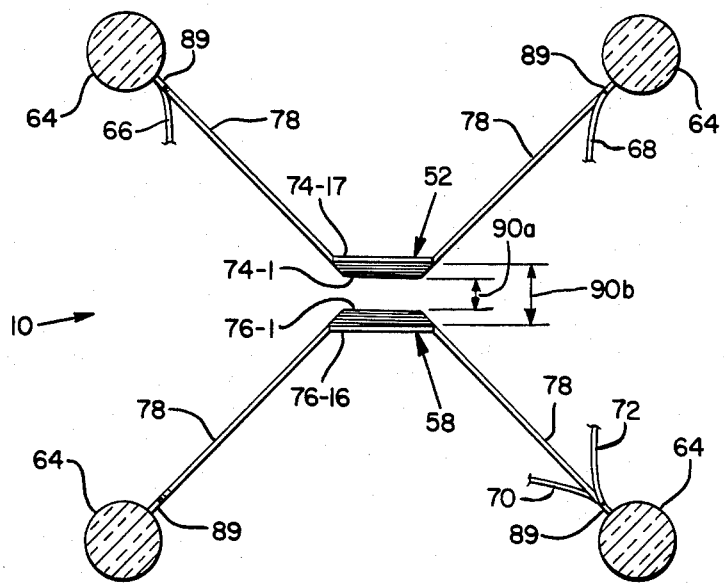
FIG. 3

TRAVELING WAVE PUSH-PULL ELECTRON BEAM DEFLECTOR WITH PITCH COMPENSATION

TECHNICAL FIELD

This invention relates to deflection structures for deflecting electron beams, and in particular, to a traveling wave delay line type deflection structure having the capability of achieving a relatively high characteristic impedance which remains substantially uniform along the length of the line.

BACKGROUND ART

A delay line deflection structure is a deflection apparatus of the traveling wave type used in cathode ray tubes for high frequency oscilloscopes to reduce the magnitude of deflection signal velocity in the direction of the travel of electrons in the electron beam. Traveling wave delay line deflection structures generally comprise a pair of deflection members disposed on opposite sides of and extending along the path of an electron beam. An electric field varying in intensity and direction in accordance with the magnitude and polarity of the deflection signal deflects the electron beam. A delay is introduced to reduce the speed of deflection signal propagation along the deflection structure until it equals the speed of the beam electrons, thereby allowing accurate beam deflection with very high frequency signals.

Parameters governing signal delay include (1) the lengths of the delay line lead portions interconnecting deflection elements extending transversely of and distributed along the path of the electron beam and (2) the effective values of the distributed inductance and capacitance components, which affect the speed of wave propagation along the line. The precise nature and value of the component impedances depend upon the particular design of delay line structure. A delay line deflection structure of the traveling wave type is a transmission line having a characteristic impedance, which is defined as the apparent impedance of an infinitely long transmission line at any point. Terminating a transmission line of finite length with an impedance having a value equal to its uniform characteristic impedance produces a line simulating a transmission line of infinite length and prevents signal reflections from the termination impedance that tend to produce signal wave form distortion.

The characteristic impedance of a delay line deflection structure is an aggregate of the intricately related, complex impedance components distributed along the length of the line. These include primarily the inductance per unit length and the capacitance per unit length between the line and the member serving as the ground electrode or plane. Inductance is directly proportional to the spacing between the line and the ground plane and is inversely proportional to the width of the line. Capacitance is inversely proportional to the spacing between the line and the ground plane and is directly proportional to the width of the line. The capacitance between adjacent deflection elements of the delay line and the capacitance between adjacent lead portions interconnecting these elements also materially affect the characteristic impedance.

Delay line deflection apparatus generally include meander line and helical deflection structures. By virtue of its design, a helical deflection structure has an inherent capability of providing characteristic impedances exceeding those obtainable in meander line deflection structures. Helical deflection structures are, however, more expensive to manufacture and difficult to assemble.

Maintaining a substantially uniform impedance along the length of a transmission line is necessary to prevent reflection of the deflection signal back toward the input end. In addition, a transmission line type electron beam deflector with a high characteristic impedance reduces the load on, and thereby the current drawn from, the vertical amplifier driving the electron beam deflector in a cathode ray oscilloscope. A high load impedance is beneficial in enhancing the deflection sensitivity of the oscilloscope, reducing amplifier power consumption, simplifying heat sinking requirements for active semiconductor devices, and permitting the use of power transistors of less sophisticated design.

Certain deflection structures are adapted to be driven by the output of a single-ended vertical amplifier. In deflection structures of this type, the deflection signal is applied to a single deflection member to vary the intensity and direction of the electric field between the deflection member and a ground plane positioned on the opposite side of the beam from such deflection member.

Other deflection structures have been designed to be driven by the output of a double-ended vertical amplifier operating in a push-pull configuration. These push-pull deflection structures heretofore have comprised a pair of identical deflection members, each connected to an output of the vertical amplifier. Vertical deflection signal voltages of opposite phase are produced by the push-pull vertical amplifier. These vertical deflection signals propagate along the deflection members at the same speed as that of the electrons in the electron beam to vary the intensity of the electric field between the deflection members. Each deflection member serves as the ground plane for the other. The push-pull arrangement effectively doubles the deflection field intensity by applying an equal, but oppositely phased deflection signal voltage to the second deflection member to double the potential difference between the two deflection members.

Delay line type deflection structures have been disclosed heretofore for use in high frequency oscilloscope cathode ray tubes. Thus, U.S. Pat. No. 2,922,074 of Moulton issued Jan. 19, 1960, discloses a meander line type deflection structure having an elongated slotted flat deflection plate disposed face-to-face between a pair of similar flat ground plates. The slotted deflection plate, which is situated considerably closer to one of the ground plates than the other, has a plurality of narrow slots extending inwardly alternately from opposite edges thereof. The inner ends of the slots overlap to provide laterally extending conductive elements which extend transversely of the beam of electrons and provide a zigzag meander line path for a vertical deflection signal propagated along the deflection plate from the inlet end to the outlet end thereof.

The characteristic impedance of the deflection structure described in the Moulton '074 patent is changed by varying its distributed inductance and capacitance. The inductance per unit length can be changed by varying the length and width of the slots in the deflection plate, thereby changing the spacing between adjacent conductive elements of the meander line but preserving a uniform number of conductive elements per unit length along the deflection plate. The number of conductive elements per unit length is referred to as pitch. The capacitance per unit length can be changed by varying the width of the deflection plate and of the ground plates on either side thereof, and by varying the distance between the deflection plate and the nearer ground plate.

Although the Moulton '074 patent meander line deflector was disclosed with reference to a single deflection plate driven by the output of a single-ended vertical amplifier, it was suggested that a deflection structure of the push-pull type having a second identical deflection plate could be driven by a double-ended output, push-pull type vertical amplifier. Unlike the two deflection members of the present invention, however, such pair of deflection plates would both be of the same pitch.

Unlike the present invention, the Moulton '074 patent meander line deflector comprises a complex, multilayered delay line structure including a single deflection plate having a constant pitch to achieve the characteristic impedance. For operation in a push-pull configuration, a second identical deflection plate is added within the structure for positioning in accordance with a complex alignment procedure.

U.S. Pat. No. 3,174,070 of Moulton issued Mar. 16, 1965, discloses a deflection structure similar to that described in the Moulton '074 patent, but a portion of one ground plate is replaced by a short section of zigzag deflection plate to provide a compensation means for improving high frequency and transient signal response. A deflection structure of this type cannot be driven by the output of a double-ended, push-pull vertical amplifier.

U.S. Pat. No. 3,504,222 of Fukushima issued Mar. 31, 1970, describes several embodiments of delay line deflection structures that include a meander line of conducting material in the form of a flat serpentine strip. The characteristic impedance of the meander line is adjusted by interposing grounded shield members between the pitch intervals in the meander line strip. The shield members alter the capacitance between adjacent meander line elements to improve the dispersion characteristics of the deflection structure. In addition, Fukushima discloses the use of tapered sections within the meander line structure to alter the impedances thereof.

Each embodiment disclosed in Fukushima is a single meander line structure spaced from a ground plate, thereby rendering each embodiment suitable as an output load for only a single-ended vertical amplifier. At least one embodiment is shown having the meader line member and the opposed ground plate curving outwardly to provide a flared-apart space at the output end of the deflection structure. The flared output section provides clearance for deflection of the electron beam and raises the impedance of the deflection structure near the output end thereof. In all embodiments, the pitch is held constant along the entire length of the meander line member. There is no disclosure of pitch compensation or any other means to accomplish a uniform characteristic impedance by compensating for the increased impedance at one end due to the flared spacing between deflection members.

U.S. Pat. No. 4,207,492 of Tomison, et al. issued June 10, 1980, describes an electron beam deflection structure for a high frequency cathode ray tube incorporating a meander line delay line structure. The deflection system includes an opposed pair of identical deflection members each comprising a serpentine meander line having a series of U-shaped loops formed by a pair of interconnected lead portions. Each lead portion is connected to a deflection plate segment of greater width along the beam path. The deflection members flare apart approximately one-third the way down the length of the deflection structure toward the output end and are adapted to be driven by a double-ended, push-pull vertical amplifier.

For each deflection member of Tomison, et al., the radii of curvature of the U-shaped loops situated near the output end are greater than those of the U-shaped loops near the input end. This produces a non-constant pitch along the length of each deflection member. Since the deflection members are identical, the pitch of each changes in the same manner along the length thereof to provide a symmetrical deflection structure having a non-constant pitch. The change in pitch along the length of the deflection structure compensates for the change in impedance due to the increased separation between the deflection members at the flared-apart output end. The increased pitch at the input end of the deflection member increases the impedance to make more uniform the impedance along the length of each line.

The deflection structure disclosed in Tomison, et al. differs from the present invention in that the former includes a symmetrical deflection structure having two identical deflection members, each with a nonuniform pitch to compensate for the increasing impedance produced by the flaring apart at the output ends.

U.S. Pat. No. Re 28,223 of Odenthal, et al. issued Nov. 5, 1974, describes a delay line deflection structure comprised of a pair of helical deflection members with rectangular turns, each having a pair of flat side lead portions connected to a deflector portion of greater width. The deflection members flare apart approximately one-half the way down the length of the deflection structure toward the output end. The width in the beam direction of the side lead portions increases successively along the path of the electron beam to help provide a uniform characteristic impedance by compensating for the increasing impedance due to the divergence of the helical deflectors.

The deflection structure also includes two pairs of grounded, adjustable compensator plates which are positioned adjacent the flat side portions on opposite sides of both helical members to form delay lines of substantially uniform characteristic impedance.

The spacing between side portions of adjacent turns of the helical structure successively decreases along the path of the electron beam, thereby preserving a substantially uniform pitch along the entire length of the deflection member. The width of and the spacing between adjacent deflector portions remain substantially constant along the entire length of each deflection member.

Unlike the present invention, the deflection structure disclosed by Odenthal, et al. is a symmetrical deflection structure comprised of a pair of identical deflection members having the same constant pitch. In addition, adjustable compensation plates are required to tune the impedance of the line.

U.S. Pat. No. 4,093,891 of Christie, et al. issued June 6, 1978, discloses a helical deflection apparatus similar to that disclosed by Odenthal, et al. Christie describes a helical deflection structure including two identical helix deflection members, each having a substantially uniform pitch along the length thereof. The adjustable compensator plates described by Odenthal, et al. are replaced by a ground plane folded into a rectangular channel and inserted into each rectangular helix deflection member.

That the impedance of a transmission line can be increased in a meander line structure comprising an insulator plate, such as a printed circuit board, carrying on opposite sides thereof two closely coupled meander lines meandering in opposite directions and having identical constant pitches was known to the inventor prior to his invention of the deflection structure disclosed herein. The present invention differs from this by employing a pair of closely coupled delay line type deflection members having different pitches that not only provide an overall increase in the characteristic impedance for the deflection structure, but also compensate for the changing impedance due to a flared-apart spacing between deflection members thereby to maintain a substantially constant characteristic impedance.

DISCLOSURE OF THE INVENTION

The primary object of this invention is to provide a traveling wave delay line electron beam deflection structure comprised of a pair of asymmetrical deflection members which operate in the push-pull configuration and are capable of achieving a high, substantially uniform characteristic impedance along the length of the deflection structure.

Another important object of the invention is to provide such a deflection structure that is operable at frequencies exceeding one gigahertz and comprises a pair of opposed deflection members with different pitches to compensate for the increased impedance due to the flared spacing between the deflection structures.

A further important object is to provide such a deflection structure of simple and inexpensive construction comprised of a pair of flared-apart deflection members that requires neither the use of adjustable compensator plates nor separate shield members to compensate for an increasing characteristic impedance along the length of the structure due to the flared spacing between the deflection members.

Still another important object of this invention is to provide a meander line type of deflection structure having pitch compensation means to increase the overall characteristic impedance to a value comparable to that presently achievable with helical deflection structures.

The present invention is an electron beam deflection structure comprising deflection means of the traveling wave type including first and second deflection members of different pitches positioned on opposite sides of and extending along the path of an electron beam and flared apart at their output ends to deflect the beam in response to deflection signals applied to the deflection members. Both deflection members include a plurality of deflection plate segments connected in series by a plurality of lead portions to form a pair of transmission lines, each transmission line having a characteristic impedance that tends to vary with distance along the path of the electron beam due to the flared spacing between the deflection members. Pitch compensation means including different pitches for the first and second deflection members maintains substantially uniform the characteristic impedance of each transmission line. The different pitches are produced by different spacings between at least some of the lead portions of adjacent deflection plate segments in either deflection member.

The particular delay line structure herein disclosed by way of example is applicable to deflection structures of the meander line type. The deflection members are configured such that the currents of the deflection signals are initially 180 degrees out-of-phase at the input end of the deflection structure. Thus, the deflection signal currents travel in opposite directions through the opposed deflection plate segments of the two deflection members near the input ends of the deflection members. The difference in pitches between the two deflection members is such that the deflection signal currents eventually flow in the same direction across the opposed deflector plate segments at the output ends of such members. The resultant electromagnetic fields produced by the deflection signal currents flowing through the deflection members in an asymmetrical configuration cause the line-to-line distributed impedance for each deflection member to change along the length of the deflection structure. It is believed that pairing two meander line structures with different pitches causes a nonuniform mutual inductive coupling which produces an impedance that progressively changes along the deflection member as a function of the change in pitch mismatch.

The progressively changing impedance caused by pitch mismatch compensates for the changing characteristic impedance due to the flared spacing of the deflection members at the output portion.

In addition, a nonuniform pitch affects the delay of deflection signal propagation along a meander line structure. Thus, the degree of pitch mismatch as between opposed deflection members and the extent of pitch nonuniformity along a given deflection member must be controlled to ensure that the speed of propagation of a deflection signal is synchronized with that of the electrons propagating transversely of the deflection plate segments along the beam axis.

In the deflection structure of the present invention, the opposed deflection members having mismatched pitches compensate for the increasing characteristic impedance of the flared portion at the output of the deflection structure to provide a substantially uniform characteristic impedance which is of higher value than was previously achievable with meander line structures.

Additional objects and advantages of the present invention will be apparent from the following detailed description of a preferred embodiment thereof which proceeds with reference to the accompanying drawings.

BRIEF DESCRIPTION OF DRAWINGS

FIG. 1 is a longitudinal section view of a high frequency cathode ray tube incorporating the electron beam deflection structure of the present invention;

FIG. 2 is an enlarged fragmentary side view of the vertical deflection structure in the cathode ray tube shown in FIG. 1;

FIG. 3 is an enlarged vertical section view taken along line 3—3 of FIG. 2;

BEST MODE FOR CARRYING OUT THE INVENTION

Figure 4:
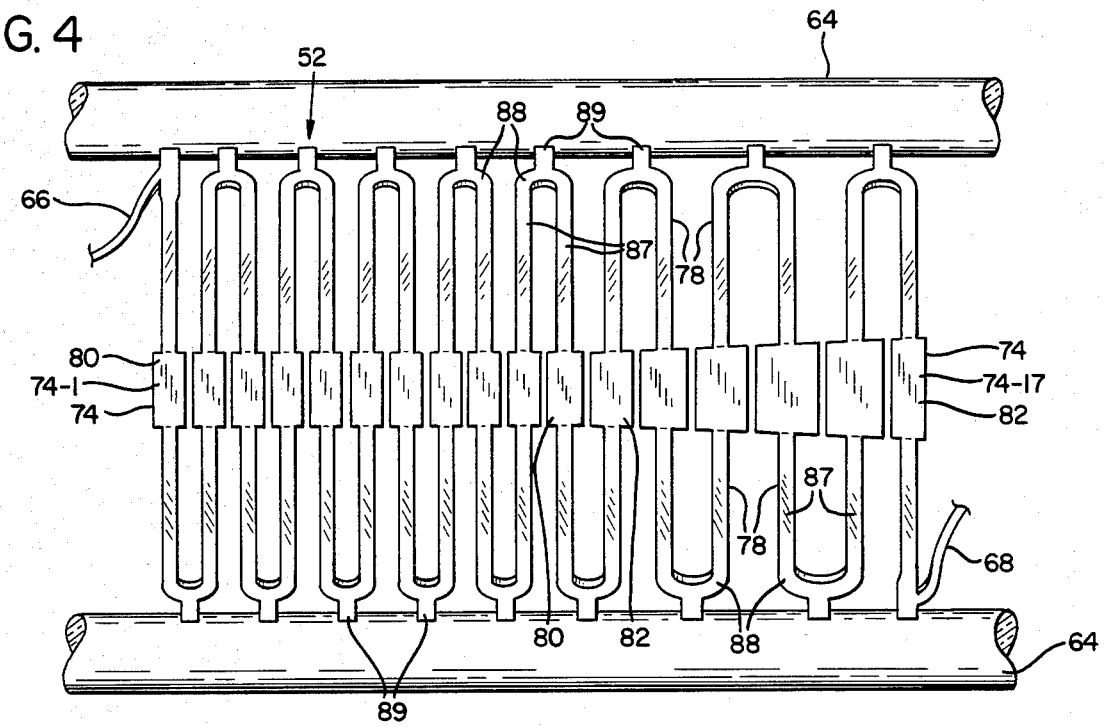
FIG. 4 is an enlarged fragmentary plan view taken along line 4—4 of FIG. 2 showing the plate segments of the upper deflection member.

With reference to FIG. 1, a traveling wave delay line type of electron beam deflection structure 10 in accordance with the present invention is contained within the evacuated envelope of an otherwise conventional cathode ray tube 12. The envelope includes tubular glass neck 14, ceramic funnel 16, and transparent glass face plate 18 sealed together by devitrified glass seals as taught by U.S. Pat. No. 3,207,936 to Wilbanks, et al. A layer 20 of a phosphor material is coated on the inner surface of face plate 18 to form a fluorescent display screen for the cathode ray tube. Electron gun 22 including cathode 24 and focusing anodes 25 is supported inside neck 14 at the opposite end of the tube to produce a focused beam 26 of electrons directed toward the fluorescent screen.

Electron beam 26 is deflected in the vertical direction by the delay line deflection structure 10 and in the horizontal direction by a pair of conventional electrostatic deflection plates 28 when deflection signals are applied thereto. Subsequent to deflection, the electron beam is accelerated by a high potential electrostatic field and strikes the display screen at a high velocity. This post-deflection acceleration field is produced between mesh electrode 30 and a thin, electron transparent aluminum film 32 overlaying phosphor layer 20. Film 32 is electrically connected to conductive layer 34 deposited on the inner surface of funnel 16. Conductive layer 34 terminates just to the left of electrode 30 as shown and is connected through feed-through connector 36 to an external high voltage DC source of approximately +3 kilovolts when cathode 24 is grounded.

Mesh electrode 30 is supported on metal ring 38 attached to the forward end of support cylinder 40. A plurality of spring contacts 42 attached to the rear end of the cylinder engage a conductive coating 44 on the inner surface of neck 14. Mesh electrode 30 and support cylinder 40 are electrically connected through base pins 46 to the average potential difference between horizontal deflection plates 28, which is approximately ground potential. This provides a field-free region between electrode 30 and the output ends of horizontal deflection plates 28. The electrodes of electron gun 22 are connected to the exterior of the envelope and to external circuitry through base pins 46.

Each vertical deflection member in deflection structure 10 has separate input and output neck pins. Neck pins 48 and 50 are attached to the input end and the output end, respectively, of upper deflection member 52; and neck pins 54 and 56 are attached to the input end and the output end, respectively, of lower deflection member 58. Each input neck pin 48 and 54 is connected to one output of a double-ended, push-pull vertical amplifier (not shown), which provides the vertical deflection signal voltages of a cathode ray oscilloscope. Resistor 60 is connected to output pin 50 to terminate upper deflection member 52 in its characteristic impedance, and resistor 62 is connected to output pin 56 to terminate lower deflection member 58 in its characteristic impedance. Horizontal deflection plates 28 are also connected to neck pins (not shown) which extend through the envelope neck portion and are connected to the time base ramp voltage outputs of the horizontal amplifier of the oscilloscope.

With reference to FIG. 2, electron beam deflection structure 10 of the present invention includes an opposed pair of nonidentical meander line deflection members 52 and 58, each of which is supported by a different pair of glass support rods 64. As shown in FIG. 1, rods 64 also serve as the principal support means for electron gun 22 and for horizontal deflection plates 28. Input lead 66 and output lead 68 of upper deflection member 52 are connected to neck pins 48 and 50, respectively. Input lead 70 and output lead 72 of lower deflection member 58 are connected to neck pins 54 and 56, respectively. It should be noted that deflection members 52 and 58 form an asymmetrical deflection structure 10 because the deflection members have different, nonuniform pitches along their respective lengths. Seventeen deflection plate segments 74 of upper deflection member 52 and sixteen deflection plate segments 76 of lower deflection member 58 are positioned transversely of and spaced longitudinally along the path of electron beam 26 (FIG. 1). The additional plate segment 74 in deflection member 52 causes overlapping of at least some of the opposed plate segments 74 and 76 along the length of deflection structure. To provide clearance for the deflected electron beam, deflection members 52 and 58 diverge or flare apart at the output ends thereof. The flaring starts approximately three-fifths the distance along the length of the deflection members.

Deflection members 52 and 58 each include a plurality of deflection plate segments 74 and 76, respectively, which are electrically connected in series and supported in structure 10 by narrow, U-shaped lead portions 78 that together with the plate segments form a serpentine meander line. In the preferred embodiment, lead portions 78 of both deflection members are of identical, uniform width.

Figure 6:
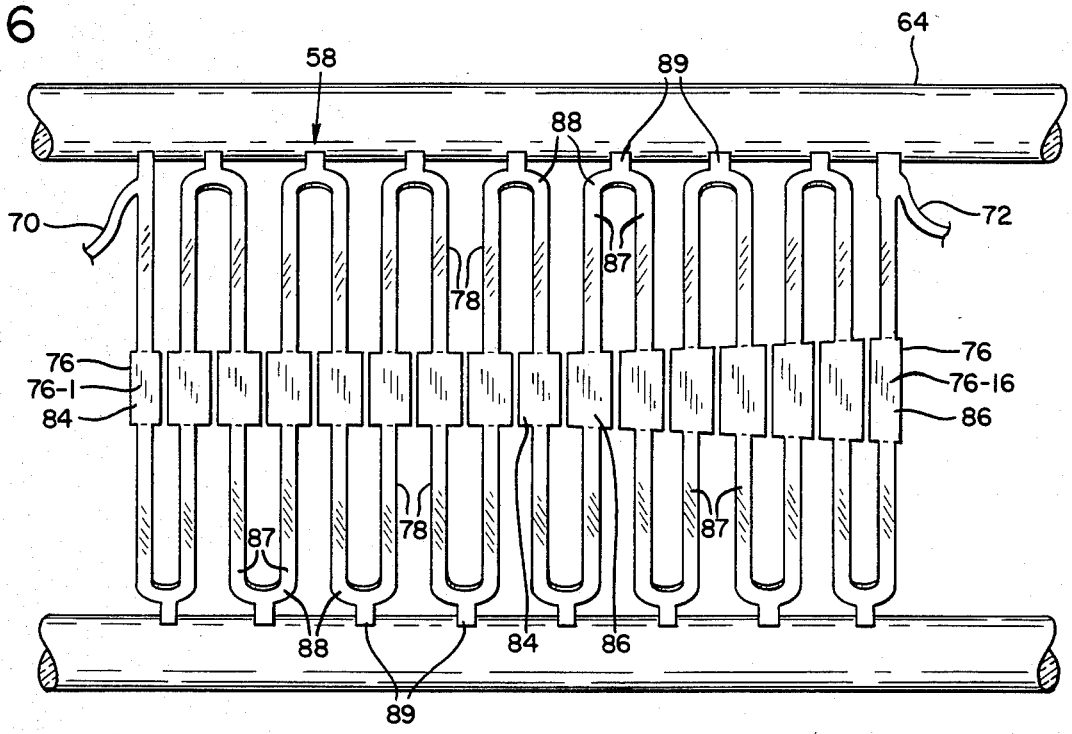
FIG. 6 is an enlarged fragmentary plan view taken along line 6—6 of FIG. 2 showing the plate segments of the lower deflection member.

With reference to FIGS. 2, 4, and 6, upper deflection member 52 has a total of seventeen plate segments 74, including eleven rectangular segments 80 of relatively similar size and six larger trapezoidal segments 82, the lengths of which increase progressively toward the output end of the deflection member. Lower deflection member 58 has a total of sixteen plate segments 76, including nine rectangular segments 84 of relatively similar size and seven larger trapezoidal segments 86, the lengths of which increase progressively toward the output end of the deflection member. For the purposes of individual identification, the plate segments of deflection member 52 have been assigned a serial position number beginning with 74-1, which corresponds to first rectangular segment 80 at the input end of the meander line, and continuing to 74-17, which corresponds to final trapezoidal segment 82 at the output end. Similarly, the plate segments of deflection member 58 have been assigned a serial position number beginning with 76-1, which corresponds to first rectangular segment 84 at the input end of the meander line, and continuing to 76-16, which corresponds to final trapezoidal segment 86 at the output end. For the sake of clarity, however, most of these identification numbers have been omitted from the drawings.

As shown in FIGS. 1 and 2, for either deflection member, lead portions 78 extend from the sides of the plate segments in a direction perpendicular to the electron beam path and interconnect adjacent plate segments in the meander lines. Each lead portion 78 is in the form of a U-shaped loop comprising two elongated leg segments 87 connected by semicircular segment 88 as shown in FIGS. 4 and 6. Each leg and semicircular segment is of uniform width. The radius of curvature of semicircular segment 88 is equal to the distance between the centerlines of the leg segments 87. Each leg segment extending from a plate segment is parallel to the adjacent leg segments. As will be further hereinafter described, the lengths of lead portions 78 constitute one of the factors establishing the time delay that is required to synchronize the speed of propagation of the vertical deflection signals traveling between the input and output ends of the deflection members 52 and 58 with that of the electrons in the beam passing between those members in structure 10. Also affecting the speed of deflection signal propagation is the value of the distributed impedance at a given section of the line. It is known that a portion of the meander line wherein the leg segments are more closely spaced apart will contribute less deflection signal delay.

For both deflection members, the sections of the meander lines formed by plate segments 74 and 76 are of relatively low impedance because of the increased capacitance caused by their relatively large width. The narrower lead portions 78 offset the low impedance of the plate segments by increasing the inductance, thereby increasing the overall impedance of the meander line. The widths of plate segments 74 increase along the length of the meander line to compensate for the decreased pitch of deflection member 52 at the output end of the deflection structure. The plate segments are widened to preserve the uniform spacing between adjacent plate segments so as to form a substantially continuous electrode for providing a uniform deflection field to the electron beam. The spacing between adjacent plate segments 74 of deflection member 52 is slightly less than that of adjacent plate segments 76 of deflection member 58 to provide equal overall lengths of the deflection members along the path of electron beam 26. The lengths of plate segments 74 and 76 increase near the output end of the deflection structure to produce a higher energy electric field to ensure uniformity at the output end where the electrodes flare apart. A high energy electric field at the output end reduces the effect of the fringe fields which degrade the dispersion characteristics of the cathode ray tube.

Integrally joined to and extending from the apex of each semicircular segment 88 of lead portion 78 is a mounting stub 89. Mounting stubs 89 extend through glass rods 64 to support the deflection members in the vertical deflection structure. Stub 89 is of sufficient width to secure adequately the deflection members to glass rods 64 but is kept as small as possible to reduce the capacitance between adjacent stubs.

With reference to FIGS. 1, 2, and 3, upper deflection member 52 and lower deflection member 58 shown mounted in glass rods 64 are of different pitches and thereby form an asymmetrical deflection structure 10. The overall lengths of deflection members 52 and 58 measured in the direction of the path of electron beam 26 are substantially equal, and lead portions 78 of the opposed plate segments at the input and output ends are in substantial alignment. However, since each deflection member has a different pitch, there is misalignment of many of the opposed plate segments.

The lead portions of each deflection member are bent from the plate segments in the direction away from those of the opposite member, at preferably 45° from the plane formed by the plate segment as shown in FIG. 3. Lead portions 78 are bent so that mounting stubs 89 intercept support rods 64 to form a rectangular cross-sectional pattern suitable for mounting in cathode ray tube 12. In addition, bending lead portions 78 in this manner minimizes parasitic capacitance between opposed lead portions.

As shown best in FIGS. 2 and 3, opposed deflection members 52 and 58 are uniformly spaced apart at distance 90*a* from plate segment 74-1 at the input end to the right edge of plate segment 74-11 of upper deflection member 52 and from plate segment 76-1 at the input end to the right edge of plate segment 76-9 of lower deflection member 58. In the preferred embodiment, spacing distance 90*a* is 1.1938 mm. The right edges of plate segments 74-11 and 76-9 are in substantial alignment, after which deflection members 52 and 58 begin to diverge. Reference line 91 indicates the point at which the spacing between the opposed deflection members progressively increases toward the output end of structure 10. At the output end, plate segments 74-17 and 76-16 are spaced apart at distance 90*b*. In the preferred embodiment, spacing distance 90*b* is 2.286 mm. It should be noted that trapezoidal deflection plate segments 82 and 86 increase in width to compensate for the flaring to preserve the substantially uniform spacing between adjacent plate segments. Thus, in deflection members 52 and 58, the respective rectangular plate segments 80 and 84 comprise the uniformly spaced-apart portion, and the respective trapezoidal plate segments 82 and 86 comprise the flared-apart portion of structure 10.

Figure 5:
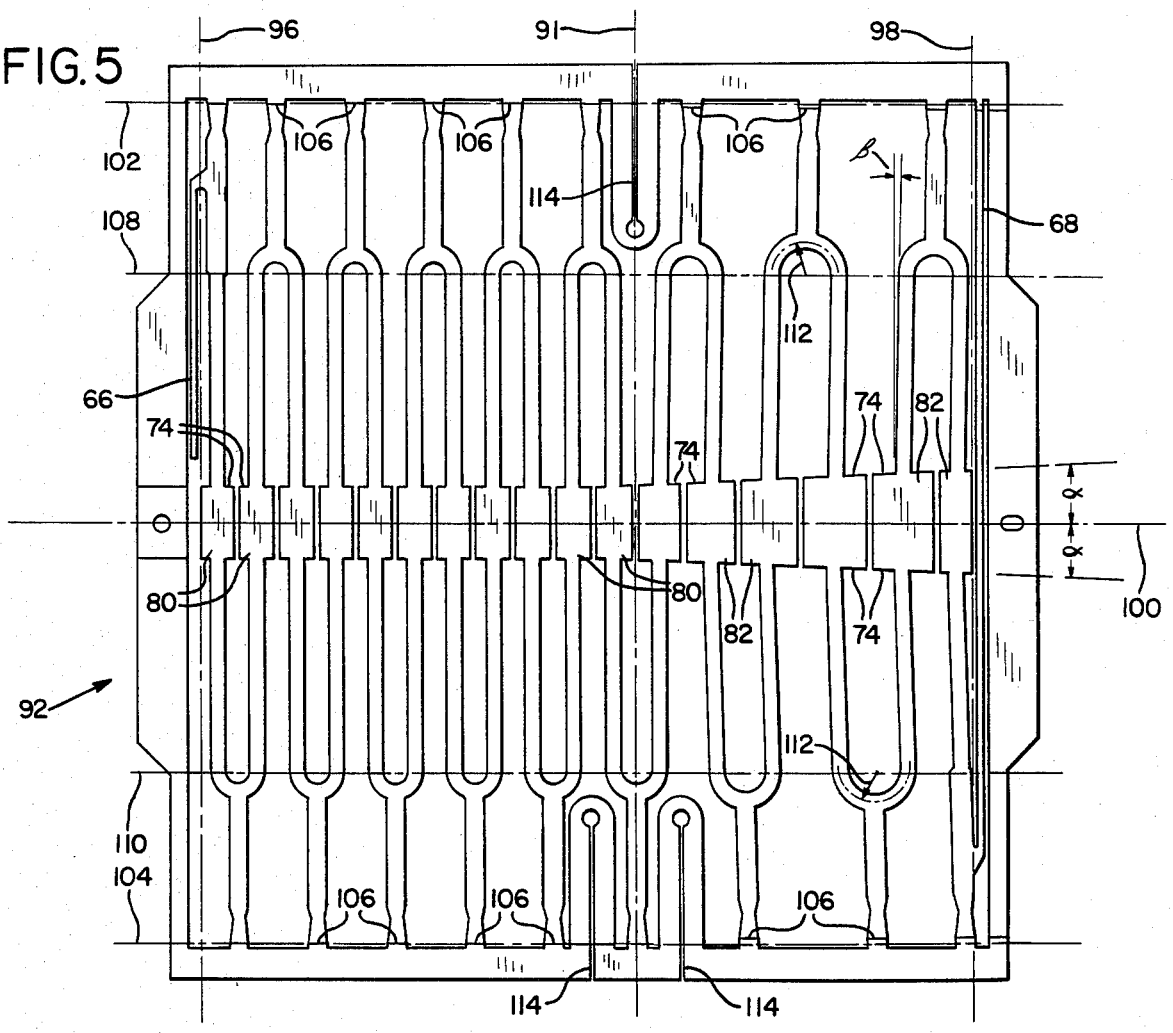
FIG. 5 is an enlarged plan view of the shaped metal sheet used to form the upper deflection member of FIG. 4.
Figure 7:
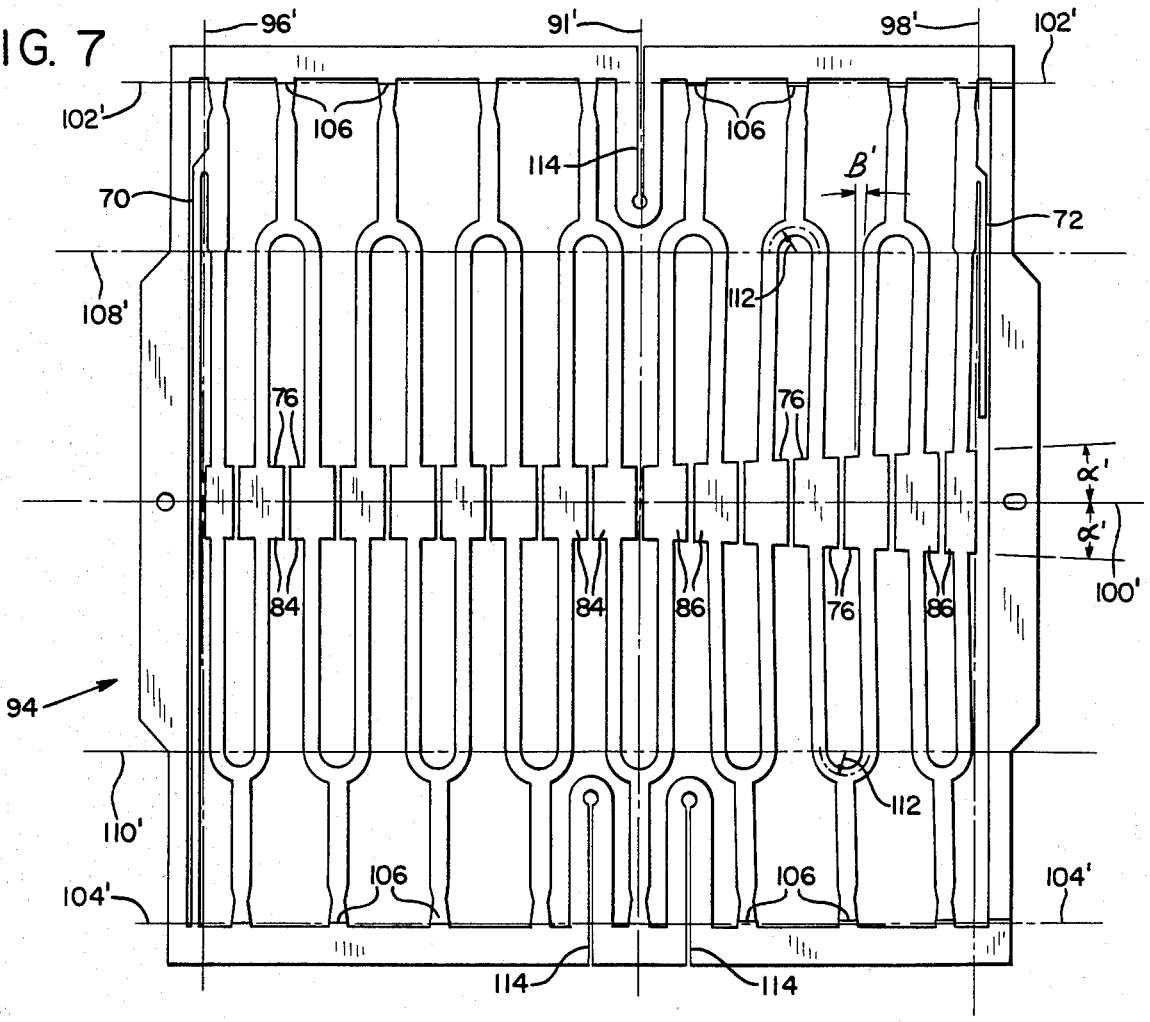
FIG. 7 is an enlarged plan view of the shaped metal sheet used to form the lower deflection member of FIG. 6.

With respect to FIGS. 5 and 7, sheet metal blanks 92 and 94 are shown for upper deflection member 52 and lower deflection member 58, respectively. Since there are numerous similarities between the blanks shown in FIGS. 5 and 7, the general discussion directed to the common aspects thereof is made with reference to FIG. 5. The same reference numerals followed by primes are used in FIG. 7 to show corresponding reference lines.

The overall length of each deflection member along the path of electron beam 26 is approximately 3.048 cm as measured between reference lines 96 and 98, which define the input and output ends, respectively, thereof. For upper deflection member 52, shown in.FIG. 5, seventeen elongated plate segments 74 are disposed side-by-side in edge parallel relation along longitudinal centerline 100 of blank 92. The overall length of 3.048 cm represents the sum of the widths of the seventeen plate segments, which are laterally centered on centerline 100, and the sixteen space intervals between adjacent plate segments. The widths of the plate segments as measured along centerline 100 are listed in Table I. Adjacent plate segments 74 are uniformly spaced apart at approximately 0.5334 mm. For lower deflection member 58, shown in FIG. 7, sixteen elongated plate segments 76 are disposed side-by-side in edge parallel relation along longitudinal centerline 100' of blank 96. The overall length of 3.048 cm represents the sum of the widths of the sixteen plate segments, which are laterally centered on centerline 100', and the fifteen space intervals between adjacent plate segments. The widths of the plate segments as measured along centerline 100' are listed in Table II. Adjacent plate segments 76 are uniformly spaced apart at approximately 0.5588 mm.

TABLE I

| Plate Segment No. | Width (mm) | Semicircular Segment Radius (mm) |
|---|---|---|
| 74-1 | 1.0414 | 0.7874 |
| 74-2 | 1.0414 | 0.7874 |
| 74-3 | 1.0414 | 0.7874 |
| 74-4 | 1.0414 | 0.7874 |
| 74-5 | 1.0414 | 0.7874 |
| 74-6 | 1.0414 | 0.7874 |
| 74-7 | 1.0414 | 0.7874 |
| 74-8 | 1.0414 | 0.7874 |
| 74-9 | 1.0414 | 0.7874 |
| 74-10 | 1.0414 | 0.8255 |
| 74-11 | 1.1938 | 0.90932 |
| 74-12 | 1.3716 | 1.02362 |
| 74-13 | 1.651 | 1.16332 |
| 74-14 | 1.9304 | 1.30302 |
| 74-15 | 2.2098 | 1.35382 |
| 74-16 | 2.1336 | 1.06172 |
| 74-17 | 1.0414 | |

TABLE II

| Plate Segment No. | Width (mm) | Semicircular Segment Radius (mm) |
|---|---|---|
| 76-1 | 0.889 | 0.8509 |
| 76-2 | 1.4478 | 0.9906 |
| 76-3 | 1.4478 | 0.9906 |
| 76-4 | 1.4478 | 0.9906 |
| 76-5 | 1.4478 | 0.9906 |
| 76-6 | 1.4478 | 0.9906 |
| 76-7 | 1.4478 | 0.9906 |
| 76-8 | 1.4478 | 0.9906 |
| 76-9 | 1.4478 | 0.9906 |
| 76-10 | 1.4478 | 0.9906 |
| 76-11 | 1.4478 | 0.9906 |
| 76-12 | 1.4478 | 0.9906 |
| 76-13 | 1.4478 | 0.9906 |
| 76-14 | 1.4478 | 0.9906 |
| 76-15 | 1.4478 | 0.8636 |
| 76-16 | 0.9398 | |

The overall width of each deflection member is approximately 3.292 cm as measured between reference lines 102 and 104, which intersect the clip lines 106 for cutting the lead portions included between reference lines 91 and 96. The lengths of the rectangular plate segments of both deflection members are approximately 2.794 mm. Beginning at reference line 91, which represents the point where each deflection member is bent to provide increased spacing between the trapezoidal segments of the opposed deflection members, the lengths of the trapezoidal segments of both deflection members increase in accordance with angle $\alpha$, which is equal to approximately 2.6324° relative to centerline 100.

For both deflection members, each lead portion 78, including the straight and semicircular segments thereof, has a width of approximately 0.3048 mm and is joined to the end of each plate segment at its longitudinal midline. The distance between reference lines 108 and 110, which define the straight portion of each meander line segment that includes the combined lengths of the plate segment and leg segments 87, is approximately 1.9507 cm. Semicircular segment 88 of each lead member 78 joins adjacent plate segments and has inside radius 112, which is equal to one-half the spacing between legs 87 joined thereby. Changing radius 112 varies the length of and thereby the deflection signal delay produced by the meander line. Changing radius 112 affects also the impedance of the deflection member by varying the spacing between adjacent leg segments 87 and thereby the pitch of the deflection member. Radius 112 of curvature varies in accordance with the values listed in Column 3 in Table I for deflection member 52 and in Column 3 of Table II for deflection member 58. Column 3 of Tables I and II is arranged so that radius 112 of a particular semicircular segment 88 is interposed in the space between the identification numbers of the plate segments interconnected thereby. It is apparent that increasing radius 112 produces a corresponding decrease in length of mounting stub 89, which length is measured between the apex of a semicircular segment 88 and a clip line 106.

The lead portions between reference lines 91 and 98 are inclined toward reference line 98 at an angle $\beta$ of approximately 1.092°. Thus, eleven leg segments 87 of deflection member 52 and thirteen leg segments 87 of deflection member 58 are inclined in this manner. This is done to compensate for the horizontal displacement of the plate segments where the deflection members flare apart so that all lead portions 78 and mounting stubs 89 will be aligned perpendicularly to glass mounting rods 64 and the path of the electron beam 26. The width of the input and output leads for each deflection member is 0.254 mm.

Prior to removal from its surrounding frame, each deflection member is bent along reference line 91 at an angle of approximately 1.092° relative to the plane formed by the plate segments included between reference lines 91 and 96 to produce the flared-apart portion at the output of deflection structure 10. Expansion joints 114 provide stress relief to facilitate the bending operation described hereinabove.

The deflection member is removed from the frame by cutting the ends of mounting stubs 89 at clip lines 106. Upon removal of the deflection member from the frame, lead portions 78 are bent at the edges of the plate segments to form an angle of approximately 45° relative to the surface of the plate segments. The deflection member is then positioned with the opposed deflection member in a cathode ray tube mounting fixture whereupon glass support rods 64 heated to their melting point are pressed onto all support stubs 89 simultaneously.

With reference to FIGS. 1 and 2, during operation of a cathode ray tube incorporating a deflection structure of the present invention, deflection signals of very high frequencies up to 1 gigahertz transmitted from the outputs of a push-pull vertical amplifier are applied to neck pins 48 and 54 of deflection structure 10. The lead portions 78 connecting the plate segments 74 and 76 at the input ends of respective deflection members 52 and 58 meander in opposite directions. This increases the coupling of the electromagnetic fields produced by the deflection signals in the region of the opposed plate segments, thereby raising the overall impedance of deflection structure 10 at the input end. For closely coupled deflection members such as those disclosed herein, the characteristic impedance of each meander line is equivalent to the other. The characteristic impedance is, therefore, sometimes herein referred to as that of the entire deflection structure 10.

A deflection signal is transmitted through lead portions 78 to increase its transit time between adjacent plate segments. Thus, the high frequency deflection signal is delayed by the lead portions 78 so that its speed of transmission along the deflection structure is synchronized to the speed of propagation of the electrons of electron beam 26. The required speed of deflection signal transmission is determined not only by the length of lead portion 78, but also by the distributed impedance of the meander line.

As shown in FIG. 2, the lead portions 78 of upper deflection member 52 included between input lead 66 and reference line 91 are spaced apart more closely than those of lower deflection member 58 to produce a deflection member 52 having a larger pitch within this section of deflection structure 10. To provide deflection members of different pitches but with the same length along the path of electron beam 26, an additional deflection plate segment 74 is included in deflection member 52. This difference in pitch between deflection members 52 and 58 raises the impedance at the input end of structure 10.

The pitch of deflection member 52 gradually decreases as the spacing between adjacent lead portions increases toward the output end of structure 10 where the deflection members flare apart. This decrease in pitch gradually brings into alignment the directions of deflection signal current flow through opposed plate segments 74 and 76 and thereby reduces the inductive coupling between the deflection plate segments to decrease progressively the impedance of the deflection members toward their output ends. It will be appreciated that changing the pitch of one deflection member relative to that of the other deflection member produces the desired impedance variation. For convenience, the pitch of deflection member 52 is changed relative to the substantially constant pitch of deflection member 58 in the preferred embodiment of the invention.

The impedances of deflection members 52 and 58 increase progressively due to the flared spacing at their output ends. The gradual decrease in impedance produced by reducing the degree of pitch mismatch between the deflection members compensates for the increasing impedance due to the flaring at the output ends to provide a high, uniform impedance along the entire length of deflection structure 10.

Experimental data show that a characteristic impedance of 330 ohms is achievable in a meander line deflection structure constructed in accordance with the present invention. This represents an increase in impedance of greater than 10 percent over that achievable by the deflection structure described by Tomison, et al. In addition, the 330 ohm characteristic impedance of the present invention compares favorably with the 365 ohm characteristic impedance achievable with currently available helical designs, such as the one disclosed by Odenthal, et al.

The speed of deflection signal transmission is materially affected by the line-to-line distributed impedance. Therefore, a deflection member with a nonuniform pitch causes the deflection signal to have different transit times between adjacent plate segments as it travels along the length of the deflection member. It has been determined empirically that high frequency deflection signals transmitted along a meander line type deflection member having a relatively large pitch couple directly across to adjacent meander line segments, thereby exhibiting a decreased time delay. Thus, successful operation of a deflection structure having deflection members with different pitches requires coordination of the effects of lead portion length and line-to-line impedance for each deflection member to provide a constant speed of deflection signal transmission along the deflection structure over a wide band of frequencies.

The deflection structure of the present invention disclosed herein simultaneously achieves synchronization of the speeds of vertical deflection signals and the electron beam and provides a high, uniform characteristic impedance. The general effects produced by designing a delay line deflection structure that has opposed deflection members with different, nonuniform pitches can only be empirically determined. Thus, the operation of such a deflection structure cannot currently be characterized by mathematical expressions or electrical predictive models.

It will be obvious to those having skill in the art that many changes may be made in the above-described details of the preferred embodiment of the present invention. For example, an asymmetrical deflection structure 10 can include deflection members having dimensions, numbers of plate segments, and pitches which are different from those described herein. Therefore, the scope of the present invention should be determined only by the following claims.

I claim:

1. An electron beam deflection structure comprising traveling wave type deflection means including first and second deflection members disposed on opposite sides of and extending along the path of an electron beam for deflecting the beam in response to electrical deflection signals applied to said members, each of the deflection members including a plurality of deflection plate segments connected in series by a plurality of lead portions to form an electrical signal transmission line, the plate segments in at least a portion of the deflection structure including the output end thereof being spaced at progressively increasing distances from said path, and means for compensating for the transmission line impedance variation resulting from said increased spacing, including the provision of different pitches in said first and second deflection members resulting from different numbers of deflection plate segments in said members.

2. The deflection structure of claim 1, in which the first and second transmission lines are constructed such that deflection signal currents flow through their respective plate segments in the same direction at the imput end of the deflection structure and in opposite direction at the output end thereof.

3. The deflection structure of claim 1, in which the relative phase of the deflection signal currents flowing through the transmission lines reverses once through 180 degrees during the transmission of the signals from the input ends to the output ends of the transmission lines.

4. The deflection structure of claim 1, in which the first and second deflection members are meanderline type deflectors having a serpentine configuration.

5. The deflection structure of claim 1, in which the deflection members are of substantially the same length and one member has one more deflection plate than the other.

6. A deflection structure for a cathode-ray tube having means therein for producing a beam of electrons, said structure comprising a spaced-apart pair of traveling wave type deflection members disposed on opposite sides of the beam's path, each member including a plurality of deflection plate segments arranged in spaced, edge-to-edge relation in a row extending generally along said path, the plate segments being electrically connected in series by a plurality of lead portions joining successive pairs of said segments, the deflection members each including a divergent section adjoining the output end thereof in which the plate segments are spaced at progressively increasing distances from said path in the direction of the beam's travel, characterized in that said deflection members have different pitches produced by different numbers of plate segments therein.

7. The deflection structure of claim 6, further characterized in that the lead portions of the opposed deflection members are arranged such that deflection signal currents flow in opposite directions through the member's respective plate segments at their input ends and in the same direction at their output ends.

8. The deflection structure of claim 6, further characterized in that the deflection members are meanderline type deflectors having a serpantine configuration.

9. The deflection structure of claim 6, further characterized in that one deflection member has one more plate segment than the other.

10. An electron beam deflection structure for a cathode-ray tube having means therein for producing such a beam, comprising an asymmetrical pair of deflection members disposed in confronting relation on opposite sides of the path of said beam, with each having an input end and output end, each member including a section adjoining its output end that diverges from the beam path in the direction of beam travel, and means for applying to the input ends of said members deflection voltage signals of opposite phase.

11. The electron base structure of claim 10, in which said members each include a plurality of deflection plate segments connected in series by a plurality of lead portions of reduced width, each member having a different number of plate segments.

12. The electron beam structure of claim 11 wherein said lead portions direct the deflection signal currents of the two members to flow through the plate segmetns in opposite directions at the input ends of the members and in the same direction at their output ends.

* * * * *